US011415323B2

(12) United States Patent
Billman et al.

(10) Patent No.: US 11,415,323 B2
(45) Date of Patent: Aug. 16, 2022

(54) COOKING UTENSIL CONFIRMATION FOR A COOKTOP APPLIANCE

(71) Applicant: Haier US Appliance Solutions, Inc., Wilmington, DE (US)

(72) Inventors: David William Billman, Louisville, KY (US); Isabella Mari Cuasay, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/951,359

(22) Filed: Nov. 18, 2020

(65) Prior Publication Data

US 2022/0154939 A1 May 19, 2022

(51) Int. Cl.
*F24C 3/12* (2006.01)
*F24C 3/02* (2021.01)

(52) U.S. Cl.
CPC ..... *F24C 3/126* (2013.01); *F24C 3/027* (2013.01)

(58) Field of Classification Search
CPC .. F24C 3/126; F24C 3/027; F24C 3/12; F24C 3/124; F24C 7/08; A47J 36/00; F23N 2223/38; F24N 2241/08
USPC ..... 126/52
See application file for complete search history.

(56) References Cited

U.S. PATENT DOCUMENTS

| | | | | |
|---|---|---|---|---|
| 5,213,091 | A | 5/1993 | Beach | |
| 6,554,197 | B2 | 4/2003 | Marbach et al. | |
| 2004/0016348 | A1 | 1/2004 | Sharpe | |
| 2005/0242086 | A1 | 11/2005 | Imura | |
| 2007/0145032 | A1 | 6/2007 | Graham | |
| 2017/0188741 | A1 | 7/2017 | Thomas et al. | |
| 2017/0243515 | A1 | 8/2017 | Vengroff et al. | |
| 2018/0010804 | A1 | 1/2018 | Bach | |
| 2020/0256563 | A1* | 8/2020 | Cadima | A47J 36/321 |

FOREIGN PATENT DOCUMENTS

| | | | |
|---|---|---|---|
| CN | 201701051 | U | 1/2011 |
| CN | 107048976 | A | 8/2017 |
| CN | 110687810 | A | 1/2020 |
| EP | 2345849 | B1 | 11/2018 |
| JP | 03751358 | B2 | 3/2006 |
| JP | 2010/216693 | A | 9/2010 |

* cited by examiner

*Primary Examiner* — Vivek K Shirsat
(74) *Attorney, Agent, or Firm* — Dority & Manning, P.A.

(57) ABSTRACT

A cooktop appliance includes a gas burner for receiving a cooking utensil and a fuel regulating device for regulating a flow of fuel to the gas burner. A controller receives a command to start a closed loop cooking process and confirms the cooking utensil by obtaining a first utensil identifier from the user and a second utensil identifier from the cooking utensil. If the first utensil identifier and the second utensil identifier match, the cooking process may commence. By contrast, if the first utensil identifier and the second utensil identifier do not match, the controller may stop the cooking process and notify the user.

20 Claims, 3 Drawing Sheets

COOKING UTENSIL CONFIRMATION FOR A COOKTOP APPLIANCE

FIELD OF THE INVENTION

The present subject matter relates generally to cooktop appliances, and more particularly, to systems for confirming cookware and limiting flame size on a cooktop appliance.

BACKGROUND OF THE INVENTION

Certain cooktop appliances include gas burners for heating cooking utensils on the cooktop appliances. Some users prefer gas burners over electric heating elements due to the adjustability of gas burners. However, precisely heating a cooking utensil with a gas burner can be difficult. For example, a user commonly adjusts the gas control valve to size the burner flame to the diameter of the cooking utensil being used for efficient performance and safety. However, the user must also constantly monitor the cooking utensil and tweak the control valve to maintain a particular temperature in the cooking utensil, and such monitoring and adjustment can be tedious.

Providing automated heating with a gas burner might reduce user interaction, but also presents difficulties. Such automated heating may include estimating the temperature of the cooking utensil and adjusting a power level of the gas burner accordingly. However, in closed loop cooking, the burner flame may be automatically sized based on the particular recipe and without knowledge of the particular cooking utensil being heated on the gas burner. Notably, this may result in a flame that is too large for the cooking utensil, resulting in decreased performance and safety hazards.

Accordingly, a cooktop appliance with features for operating a gas burner to maintain a particular temperature in a cooking utensil while also operating the gas burner within an appropriate range for the cooking utensil would be useful. More particularly, a system and method for ensuring a gas burner has accurate knowledge of the cooking utensil being used would be especially beneficial.

BRIEF DESCRIPTION OF THE INVENTION

Aspects and advantages of the invention will be set forth in part in the following description, or may be apparent from the description, or may be learned through practice of the invention.

In one exemplary embodiment, a cooktop appliance is provided including a gas burner for receiving a cooking utensil, a fuel regulating device operably coupled to the gas burner for regulating a flow of fuel to the gas burner, and a controller operably coupled to the fuel regulating device. The controller is configured to receive a command to start a cooking process using the gas burner and the cooking utensil, obtain a first utensil identifier of the cooking utensil from a user of the cooktop appliance, obtain a second utensil identifier from the cooking utensil, determine that the first utensil identifier is different than the second utensil identifier, and implement a responsive action in response to determining that the first utensil identifier is different than the second utensil identifier.

In another exemplary embodiment, a method of operating a cooktop appliance is provided. The cooktop appliance includes a gas burner and a fuel regulating device for providing a flow of fuel to the gas burner to heat a cooking utensil. The method includes receiving a command to start a cooking process using the gas burner and the cooking utensil, obtaining a first utensil identifier of the cooking utensil from a user of the cooktop appliance, obtaining a second utensil identifier from the cooking utensil, determining that the first utensil identifier is different than the second utensil identifier, and implementing a responsive action in response to determining that the first utensil identifier is different than the second utensil identifier.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
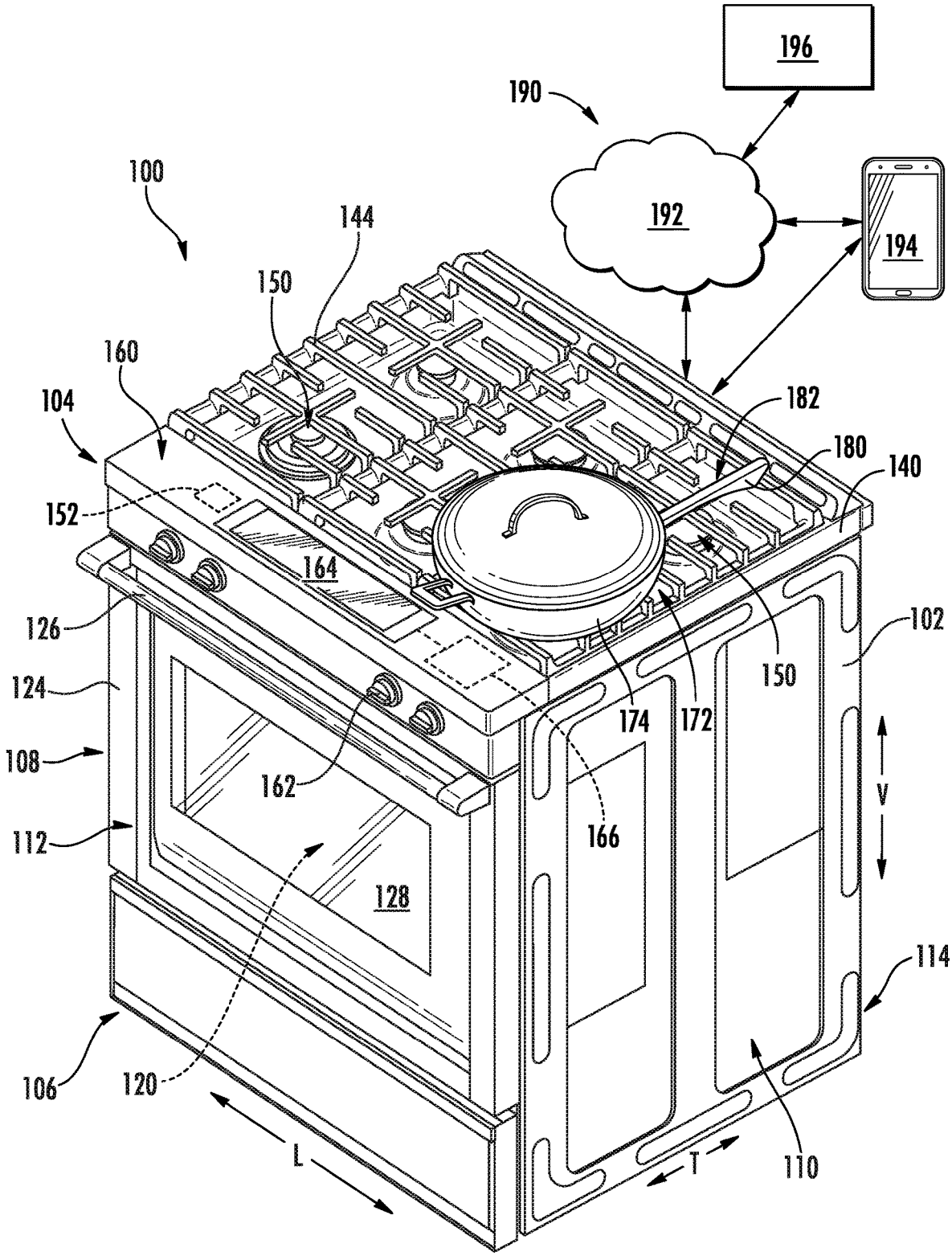
FIG. 1 provides a front perspective view of a cooking appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

FIG. 1 provides a front, perspective view of an oven appliance 100 as may be employed with the present subject matter. Oven appliance 100 generally defines a vertical direction V, a lateral direction L, and a transverse direction T, each of which is mutually perpendicular, such that an orthogonal coordinate system is generally defined. As illustrated, oven appliance 100 includes an insulated cabinet 102. Cabinet 102 of oven appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Within cabinet 102 is a single cooking chamber 120 which is configured for the receipt of one or more food items to be cooked. However, it should be appreciated that oven appliance 100 is provided by way of example only, and aspects of the present subject matter may be used in any suitable cooking appliance, such as a double oven range appliance. Thus, the example embodiment shown in FIG. 1 is not intended to limit the present subject matter to any particular cooking chamber configuration or arrangement. Indeed, aspects of the present subject matter may be applied to display assemblies for any suitable appliance, such as a standalone cooktop appliance or gas burner assembly.

Oven appliance 100 includes a door 124 rotatably attached to cabinet 102 in order to permit selective access to cooking chamber 120. Handle 126 is mounted to door 124 to assist a user with opening and closing door 124 in order to access cooking chamber 120. As an example, a user can pull on handle 126 mounted to door 124 to open or close door 124 and access cooking chamber 120. One or more transparent viewing windows 128 (FIG. 1) may be defined within door 124 to provide for viewing the contents of cooking chamber 120 when door 124 is closed and also assist with insulating cooking chamber 120.

Figure 2:
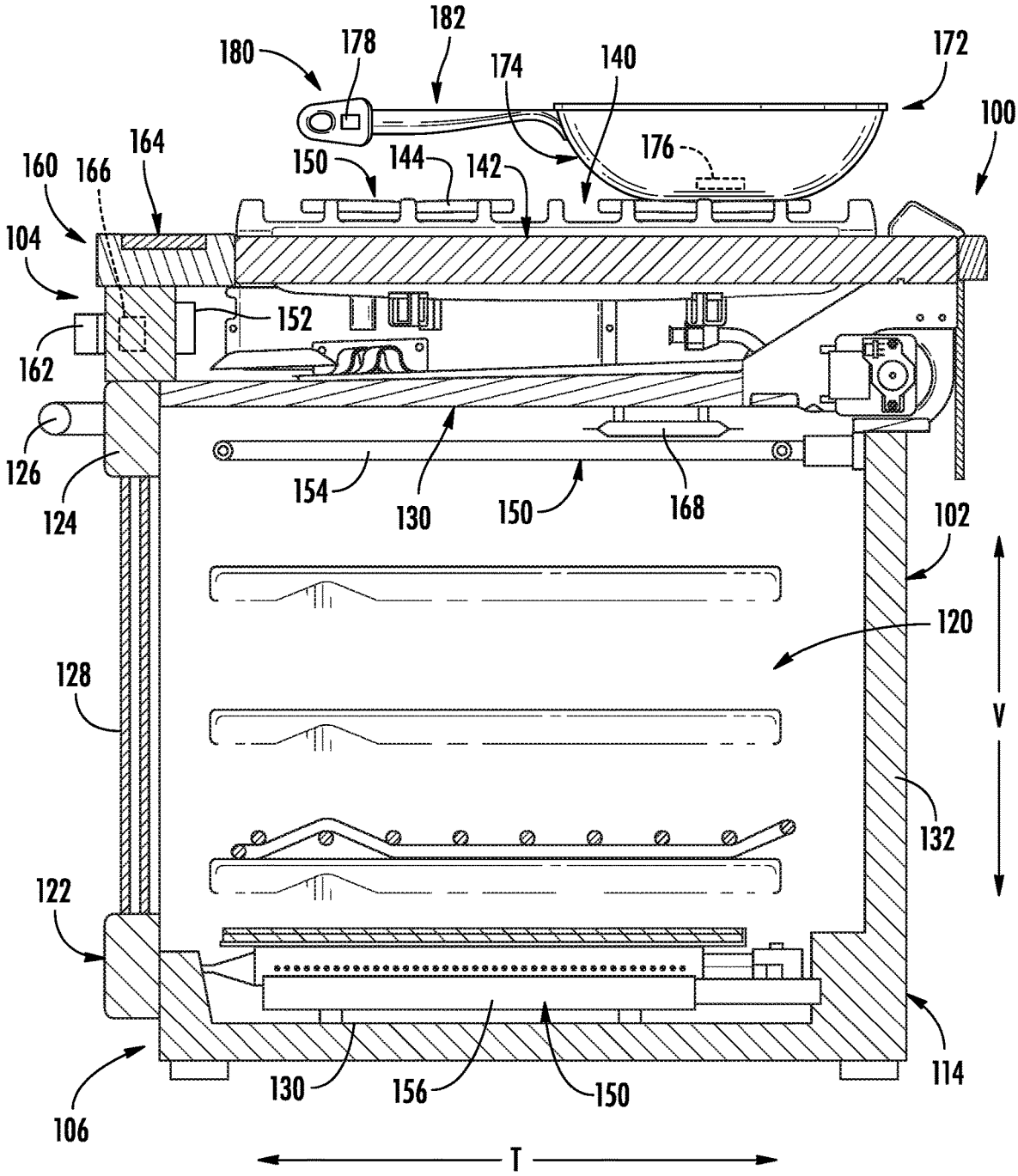
FIG. 2 provides a side cross-sectional view of the exemplary cooking appliance of FIG. 1 according to an exemplary embodiment of the present subject matter.

In general, cooking chamber 120 is defined by a plurality of chamber walls 130 (FIG. 2). Specifically, cooking chamber 120 may be defined by a top wall, a rear wall, a bottom wall, and two sidewalls 130. These chamber walls 130 may be joined together to define an opening through which a user may selectively access cooking chamber 120 by opening door 124. In order to insulate cooking chamber 120, oven appliance 100 includes an insulating gap defined between the chamber walls 130 and cabinet 102. According to an exemplary embodiment, the insulation gap is filled with an insulating material 132, such as insulating foam or fiberglass, for insulating cooking chamber 120.

Oven appliance 100 also includes a cooktop 140. Cooktop 140 is positioned at or adjacent top 104 of cabinet 102 such that it is positioned above cooking chamber 120. Specifically, cooktop 140 includes a top panel 142 positioned proximate top 104 of cabinet 102. By way of example, top panel 142 may be constructed of glass, ceramics, enameled steel, and combinations thereof. One or more grates 144 are supported on a top surface of top panel 142 for supporting cooking utensils, such as pots or pans, during a cooking process.

Oven appliance 100 may further include one or more heating elements (identified generally by reference numeral 150) for selectively heating cooking utensils positioned on grates 144 or food items positioned within cooking chamber 120. For example, referring to FIG. 1, heating elements 150 may be gas burners 150. Specifically, a plurality of gas burners 150 are mounted within or on top of top panel 142 underneath grates 144 that supports cooking utensils over the gas burners 150 while gas burners 150 provide thermal energy to cooking utensils positioned thereon, e.g., to heat food and/or cooking liquids (e.g., oil, water, etc.). Gas burners 150 can be configured in various sizes so as to provide e.g., for the receipt of cooking utensils (i.e., pots, pans, etc.) of various sizes and configurations and to provide different heat inputs for such cooking utensils. According to alternative embodiments, oven appliance 100 may have other cooktop configurations or burner elements. One or more fuel regulating valves 152 or other suitable control valves may be operably coupled to each gas burner 150 for independently regulating a fuel flow rate to the gas burner, the flame size, etc.

In addition, heating elements 150 may be positioned within or may otherwise be in thermal communication with cooking chamber 120 for regulating the temperature within cooking chamber 120. Specifically, an upper gas heating element 154 (also referred to as a broil heating element or gas burner) may be positioned in cabinet 102, e.g., at a top portion of cooking chamber 120, and a lower gas heating element 156 (also referred to as a bake heating element or gas burner) may be positioned at a bottom portion of cooking chamber 120. Upper gas heating element 154 and lower gas heating element 156 may be used independently or simultaneously to heat cooking chamber 120, perform a baking or broil operation, perform a cleaning cycle, etc. The size and heat output of gas heating elements 154, 156 can be selected based on the, e.g., the size of oven appliance 100 or the desired heat output. Oven appliance 100 may include any other suitable number, type, and configuration of heating elements 150 within cabinet 102 and/or on cooktop 140. For example, oven appliance 100 may further include electric heating elements, induction heating elements, or any other suitable heat generating device.

A control panel assembly 160 is located within convenient reach of a user of the oven appliance 100. For this example embodiment, control panel assembly 160 is positioned at a top 104 and front 112 of cabinet 102, e.g., above door 124 along the vertical direction V and forward of cooktop 140 along the transverse direction T. Control panel assembly 160 includes knobs 162 that are each associated with one of heating elements 150. In this manner, knobs 162 allow the user to activate each heating element 150 and determine the amount of heat input provided by each heating element 150 for cooking food items within cooking chamber 120 or on cooktop 140. Although shown with knobs 162, it should be understood that knobs 162 and the configuration of oven appliance 100 shown in FIG. 1 is provided by way of example only.

More specifically, control panel assembly 160 may include various input components, such as one or more of a variety of touch-type controls, electrical, mechanical or electro-mechanical input devices including rotary dials, push buttons, and touch pads. Control panel assembly 160 may also be provided with one or more graphical display devices or display components, such as a digital or analog display device designed to provide operational feedback or other information to the user such as e.g., whether a particular heating element 150 is activated and/or the rate at which the heating element 150 is set. Indeed, according to the illustrated embodiment, control panel assembly 160 includes a display assembly 164, such as a liquid crystal display ("LCD") that acts as both a display for providing information to a user of appliance as well as providing an interactive touch screen or touch sensitive surface through which a user may provide feedback or operating commands.

Generally, oven appliance 100 may include a controller 166 in operative communication with control panel assembly 160. Control panel assembly 160 of oven appliance 100 may be in communication with controller 166 via, for example, one or more signal lines or shared communication busses, and signals generated in controller 166 operate oven appliance 100 in response to user input via user input devices, e.g., control knobs 162 and/or display assembly 164. Input/Output ("I/O") signals may be routed between controller 166 and various operational components of oven appliance 100 such that operation of oven appliance 100 can be regulated by controller 166. In addition, controller 166 may also be communication with one or more sensors, such as temperature sensor 168 (FIG. 2), which may be used to measure temperature inside cooking chamber 120 and provide such measurements to the controller 166. Although temperature sensor 168 is illustrated at a top and rear of cooking chamber 120, it should be appreciated that other sensor types, positions, and configurations may be used according to alternative embodiments.

Controller 166 is a "processing device" or "controller" and may be embodied as described herein. Controller 166 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 166 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Although aspects of the present subject matter are described herein in the context of a single oven appliance, it should be appreciated that oven appliance 100 and cooktop 140 are provided by way of example only. Other oven or range appliances having different configurations, different appearances, and/or different features may also be utilized with the present subject matter, e.g., double ovens, stand-alone cooktops, etc. Indeed, aspects of the present subject matter may apply to any burner element, such as a countertop gas burner, electric burner, or induction heating element.

Referring still to FIGS. 1 and 2, a closed loop cooking system 172 will be described according to exemplary embodiments of the present subject matter. Generally speaking, closed loop cooking system 172 may be used to regulate the operation of gas burner 150 to heat a cooking utensil 174. Specifically, closed loop cooking system 172 may automatically adjust the output power of gas burner 150 (e.g., using fuel regulating valve 152) in response to a measured temperature of cooking utensil 174, e.g., to perform a cooking routine while ensuring that safety limits of cooking utensil 174 are not exceeded.

In general, cooking utensil 174 may be any suitable utensil, pot, pan, dish, or other food container suitable for use or otherwise compatible with gas burner 150. Notably, as described briefly above, it is desirable to appropriately size the flames emitted from gas burner 150 to the cooking utensil 174 being heated. More specifically, safety hazards or performance inefficiencies may arise if the power output of gas burner 150 generates flames which engulf or extend up the sides of cooking utensil 174. Therefore, aspects of the present subject matter are directed to methods and systems for preventing such hazardous operation of gas burner 150.

It should be appreciated that as used herein, terms such as burner power output, fuel flow rate, burner firing rate, etc., may be used interchangeably to refer to the amount of energy or flame size used to heat cooking utensil 174. Thus, for example, the burner output may be roughly proportional or have some other known relationship to the flame size generated by gas burner 150. Similarly, the fuel flow rate provided to gas burner 150 may have a known relationship with burner output power or flame size. Thus, although the method described below may refer to limiting or adjusting the fuel flow rate to gas burner 150, it should be appreciated that limits or adjustments could alternatively be placed on the power output or flame size of the gas burner to achieve the same safety goals while remaining within the scope of the present subject matter.

According to exemplary embodiments, controller 166 is also in communication with a temperature sensor 176. Temperature sensor 176 is separate from gas burner 150 and is configured to measure a temperature at cooking utensil 174 heated by gas burner 150. Thus, temperature sensor 176 may be a thermistor or thermocouple positioned on and/or disposed within cooking utensil 174 positioned above gas burner 150. Controller 166 receives temperature measurements from temperature sensor 176. In certain example embodiments, temperature sensor 176 is a separate component mountable to cooking utensil 174 heated by gas burner 150. In alternative example embodiments, temperature sensor 176 may be integrated within cooking utensil 174.

According to exemplary embodiments, closed loop cooking system 172 or cooking utensil 174 may further include a wireless transmitter/receiver, such as a wireless communication module 178 that may be in operative communication with controller 166. Wireless communication module 178 may be housed in a removable Bluetooth module 180 that is positioned on a handle 182 of cooking utensil 174. In this manner, Bluetooth module 180 and/or wireless communication module 178 may transmit temperature measurements obtained by temperature sensor 176 to controller and may transmit a cooking utensil identifier, e.g., via a Bluetooth® or Wi-Fi connection.

Notably, Bluetooth module 180 may be removable, e.g., to facilitate cleaning of the pot, when using the cooking utensil within an oven, etc. In addition, each Bluetooth module 180 may be configured for use on a single cooking utensil or type of cooking utensil. When the improper Bluetooth module 180 is placed on cooking utensil 174 by a user, controller 166 may determine that the cooking utensil is one type (e.g., based on communication from the Bluetooth module 180), when in fact the cooking utensil placed on gas burner 150 is a different type or size. Aspects of the present subject matter are intended to address this confusion and ensure optimal performance and safety of gas burner 150.

Referring still to FIG. 1, a schematic diagram of an external communication system 190 will be described according to an exemplary embodiment of the present subject matter. In general, external communication system 190 is configured for permitting interaction, data transfer, and other communications between and among oven appliance 100, a remote server, and/or a user of oven appliance 100. For example, this communication may be used to provide and receive operating parameters, cycle settings, performance characteristics, user preferences, utensil identifiers, or any other suitable information for improved performance of oven appliance 100.

Using oven appliance 100 as an exemplary application, external communication system 190 permits controller 166 of oven appliance 100 to communicate with external devices either directly or through a network 192. For example, a consumer may use a consumer device 194 to communicate directly with oven appliance 100. Alternatively, these appliances may include user interfaces for receiving such input (described below). For example, consumer devices 194 may be in direct or indirect communication with oven appliance 100, e.g., directly through a local area network (LAN), Wi-Fi, Bluetooth, Zigbee, etc. or indirectly through network 192. In general, consumer device 194 may be any suitable device for providing and/or receiving communications or commands from a user. In this regard, consumer device 194 may include, for example, a personal phone, a tablet, a laptop computer, or another mobile device.

In addition, a remote server 196 may be in communication with oven appliance 100 and/or consumer device 194 through network 192. In this regard, for example, remote server 196 may be a cloud-based server 196, and is thus located at a distant location, such as in a separate state, country, etc. In general, communication between the remote server 196 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 192 can be any type of communication network. For example, network 192 can include one or more of a wireless network, a wired network, a personal area network, a local area network, a wide area network, the internet, a cellular network, etc. According to an exemplary embodiment, consumer device 194 may communicate with a remote server 196 over network 192, such as the internet, to provide user inputs, transfer operating parameters or performance characteristics, cycle authorizations, utensil identifiers, etc. In addition, consumer device 194 and remote server 196 may communicate with oven appliance 100 to communicate similar information.

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more cooking appliances, other communication protocols and steps may be implemented, etc. These variations and modifications are contemplated as within the scope of the present subject matter.

Now that the construction of oven appliance 100, gas burners 150, and the configuration of controller 166 according to exemplary embodiments have been presented, an exemplary method 200 of operating an oven or cooktop appliance will be described. Although the discussion below refers to the exemplary method 200 of operating oven appliance 100, one skilled in the art will appreciate that the exemplary method 200 is applicable to the operation of a variety of other cooking appliances, such as gas burner assemblies. In exemplary embodiments, the various method steps as disclosed herein may be performed by controller 166 or a separate, dedicated controller.

Figure 3:
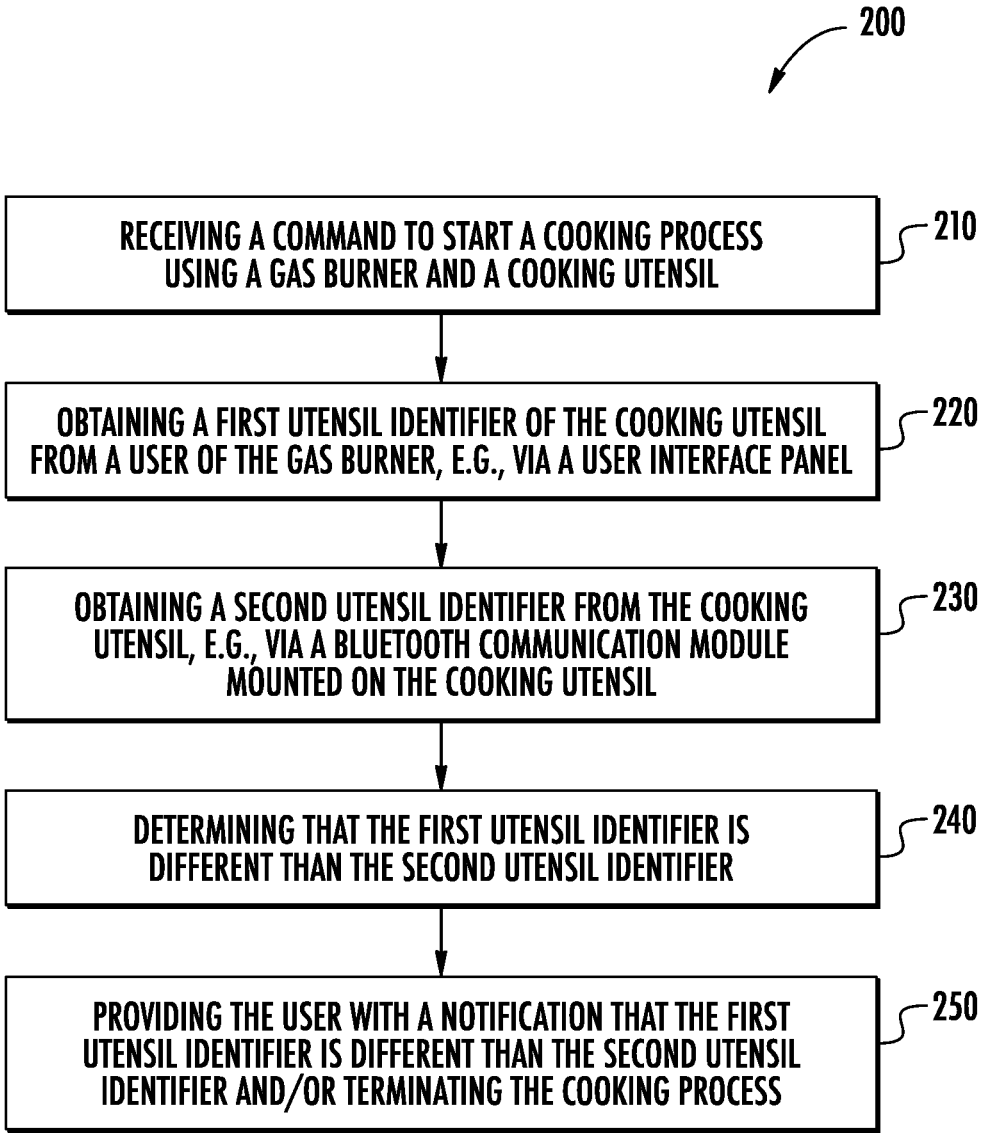
FIG. 3 illustrates a method for operating a cooktop appliance in accordance with one embodiment of the present disclosure.

Referring now to FIG. 3, method 200 includes, at step 210, receiving a command to start a cooking process using a gas burner and the cooking utensil. In this regard, continuing example from above, the user may wish to perform a closed-loop cooking cycle using closed-loop cooking system 172 and cooking utensil 174. The user may communicate such a command in any suitable manner, such as via a remote device 194 or using display assembly 164. The cooking process may include a command to operate the gas burner 150 at a single fuel flow rate or flame size, or alternatively to operate gas burner 150 according to any other suitable time-based temperature profile. Thus, for example, when a closed-loop cooking cycle is initiated, controller 166 may regulate fuel regulating valve 152 such that a utensil temperature (e.g., as measured by temperature sensor 176) tracks a target temperature, which may be a fixed temperature or a time varying temperature profile (e.g., as based on a recipe input by the user). Although gas burner 150 of oven appliance 100 is used herein the for the purpose of explaining aspects of the present subject matter, it should be appreciated that method 200 may be used to operate any suitable gas burner, cooktop appliance, or other heating element for heating any suitable cooking utensil.

Step 220 includes obtaining a first utensil identifier of the cooking utensil from a user of the gas burner. In this regard, the first utensil identifier may generally refer to the type of cooking utensil as input by the user. In this regard, for example, the first utensil identifier may be a utensil identification, such as a chef's pot, a smart pan, a sauce pot, etc. Furthermore, the first utensil identifier may include a pan diameter, volume, height, or any other suitable parameters which may affect the closed-loop cooking process. The user may provide the first utensil identifier in any suitable manner, e.g., via display assembly 164 or via a software application on a remote device, such as mobile phone 194. Generally speaking, the first utensil identifier is a user-based input on the particular cooking utensil 174 that is being used to perform the cooking process.

Step 230 includes obtaining a second utensil identifier from the cooking utensil. For example, the second utensil identifier may be communicated from cooking utensil 174, e.g., via wireless communication module 178 or Bluetooth module 180. According to exemplary embodiments, the second utensil identifier may be a utensil identification, such as a chef's pot, a smart pan, a sauce pot, etc. Furthermore, the second utensil identifier may include a pan diameter, volume, height, or any other suitable parameters which may affect the closed-loop cooking process. Cooking utensil 174 may be prompted to communicate the second utensil identifier in any suitable manner. For example, according to an exemplary embodiment, controller 166 may be configured for communicating or prompting a response from cooking utensil 174 when a user attempts to start a cooking cycle. According to still other embodiments, display assembly 164 may prompt a user to activate Bluetooth module 180, e.g., by pushing a Bluetooth button or tapping handle 182 of cooking utensil 174. Any other suitable manner of prompting cooking utensil 174 to transfer second utensil identifier be used while remaining within the scope of the present subject matter. Generally speaking, the second utensil identifier is a utensil-based input on the particular cooking utensil 174 that is being used to perform the cooking process.

Notably, as described above, cooking utensil 174 may include a removable Bluetooth module 180 that may communicate temperature measurements and the second utensil identifier to facilitate the cooking process. However, there are various conditions or situations which may result in the second utensil identifier not being associated with the proper cooking utensil, which may result in hazardous or sub optimal performance during a closed-loop cooking process.

For example, a user may install the improper Bluetooth module 180 onto a cooking utensil, e.g., such that the user has selected a chef's pot for the cooking process, but the Bluetooth module 180 communicates the second utensil identifier is the saucepan. In addition, a user may accidentally tap the wrong Bluetooth module 180 or the Bluetooth module 180 may be accidentally activated when a drawer is closed. Moreover, Bluetooth module 180 may malfunction or be damaged such that the improper utensil identifier is communicated.

Step 240 includes determining that the first utensil identifier is different than the second utensil identifier. In this regard, controller 166 may compare the first utensil identifier (e.g., received from the user at step 220) with the second utensil identifier (e.g., received from the cooking utensil at step 230). If the utensil identifiers do not match, corrective action may be desired. As result, method 200 may further include implementing a responsive action in response to determining that the first utensil identifier is different than the second utensil identifier. For example, step 250 includes providing the user with a notification that the first utensil identifier is different than the second utensil identifier. In addition, method 200 may include implementing other corrective actions, such as terminating the cooking process or implementing any other suitable corrective action. For example, when the first utensil identifier is different in the second utensil identifier, display assembly 164 may provide troubleshooting instructions, such as a notification that the activated cooking utensil does not match the user identification of the cooking utensil, along with instructions or recommended solutions for the problem. According to still other embodiments, the user notification, troubleshooting instructions, etc. may be communicated to the user via a software application on the user's mobile phone 194.

By contrast, controller 166 may alternatively determine that the first utensil identifier is identical to the second utensil identifier. In this case, controller 166 may commence the cooking process. In this regard, for example, controller 166 may regulate fuel regulating valve 152 such that a measured temperature of cooking utensil (e.g., as measured at temperature sensor 176) tracks a target temperature. In addition, controller 166 may determine based on either the first utensil identifier or the second utensil identifier, the diameter of the cooking utensil 174 (e.g., via locally stored lookup table or the via remote server 196). Controller 166 may further limit a flame size or gas burner 150 to the diameter, e.g., to improve cooking performance and eliminate safety hazards.

FIG. 3 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using oven appliance 100 as an example, it should be appreciated that these methods may be applied to the operation of any suitable cooktop appliance or gas burner assembly.

Aspects of the present subject matter provide a system and method that provides a confirmation sequence to make sure that the correct cookware is being used in closed loop cooking system. In specific, the user may select a picture of the cookware on either an LCD screen or mobile application and then tap the Bluetooth capsule on the handle of the cookware to activate the cookware. The controller compares the two user inputs (selected pan type on mobile app or LCD and tapped pan type on Bluetooth capsule), if the inputs are matched then the cooking system continues with closed loop cooking. But if there is a mismatch, the user receives an error and troubleshooting option. This confirmation may notify the controller of the cooktop to allow closed loop cooking by automatically adjusting the flame size according to the diameter of cookware being selected.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a gas burner for receiving a cooking utensil;

a fuel regulating device operably coupled to the gas burner for regulating a flow of fuel to the gas burner; and a controller operably coupled to the fuel regulating device, the controller being configured to:

receive a command to start a cooking process using the gas burner and the cooking utensil;

obtain a first utensil identifier of the cooking utensil from a user of the cooktop appliance;

obtain a second utensil identifier from the cooking utensil, wherein the second utensil identifier identifies the cooking utensil positioned on the gas burner;

determine that the first utensil identifier is different than the second utensil identifier; and implement a responsive action in response to determining that the first utensil identifier is different than the second utensil identifier.

2. The cooktop appliance of claim 1, further comprising:

a user interface panel configured to receive the command to start the cooking process from the user.

3. The cooktop appliance of claim 2, wherein the controller is further configured to:

request the first utensil identifier from the user using the user interface panel; and receive the first utensil identifier from the user through the user interface panel.

4. The cooktop appliance of claim 1, wherein the controller is communicatively coupled to a remote device for receiving the first utensil identifier.

5. The cooktop appliance of claim 1, further comprising:

a wireless communication module mounted to the cooking utensil, wherein the second utensil identifier is received from the wireless communication module.

6. The cooktop appliance of claim 5, wherein the wireless communication module is a Bluetooth module mounted to an end of a handle of the cooking utensil.

7. The cooktop appliance of claim 5, wherein the second utensil identifier is communicated to the controller when the user taps or activates the wireless communication module.

8. The cooktop appliance of claim 1, wherein implementing the responsive action comprises:

terminating the cooking process in response to determining that the first utensil identifier is different than the second utensil identifier.

9. The cooktop appliance of claim 1, wherein implementing the responsive action comprises:

providing a user with troubleshooting instructions in response to determining that the first utensil identifier is different than the second utensil identifier.

10. The cooktop appliance of claim 1, wherein implementing the responsive action comprises:

providing the user with a notification that the first utensil identifier is different than the second utensil identifier.

11. The cooktop appliance of claim 1, wherein the controller is further configured to:

determine that the first utensil identifier is identical to the second utensil identifier; and commence the cooking process.

12. The cooktop appliance of claim 11, wherein the controller is further configured to:

determine, based on the first utensil identifier or the second utensil identifier, a diameter of the cooking utensil; and limit a flame size of the gas burner to the diameter using the fuel regulating device.

13. The cooktop appliance of claim 11, wherein the controller is further configured to:

obtain a target temperature of the cooking utensil; and operate the fuel regulating device to adjust a utensil temperature to the target temperature.

14. A method of operating a cooktop appliance, the cooktop appliance comprising a gas burner and a fuel regulating device for providing a flow of fuel to the gas burner to heat a cooking utensil, the method comprising:

receiving a command to start a cooking process using the gas burner and the cooking utensil;

obtaining a first utensil identifier of the cooking utensil from a user of the cooktop appliance;

obtaining a second utensil identifier from the cooking utensil, wherein the second utensil identifier identifies the cooking utensil positioned on the gas burner;

determining that the first utensil identifier is different than the second utensil identifier; and implementing a responsive action in response to determining that the first utensil identifier is different than the second utensil identifier.

15. The method of claim 14, wherein the cooktop appliance further comprises a user interface panel configured to receive the command to start the cooking process from the user, the method further comprising:

requesting the first utensil identifier from the user using the user interface panel; and receiving the first utensil identifier from the user through the user interface panel.

16. The method of claim 14, wherein the cooktop appliance further comprises a wireless communication module mounted to the cooking utensil, wherein the second utensil identifier is received from the wireless communication module.

17. The method of claim 14, wherein implementing the responsive action comprises:

terminating the cooking process in response to determining that the first utensil identifier is different than the second utensil identifier.

18. The method of claim 14, wherein implementing the responsive action comprises:

providing a user with troubleshooting instructions in response to determining that the first utensil identifier is different than the second utensil identifier.

19. The method of claim 14, wherein implementing the responsive action comprises:

providing the user with a notification that the first utensil identifier is different than the second utensil identifier.

20. The method of claim 14, further comprising:

determining that the first utensil identifier is identical to the second utensil identifier; and commencing the cooking process.

* * * * *